US005711236A

United States Patent [19]

Badger

[11] Patent Number: 5,711,236

[45] Date of Patent: Jan. 27, 1998

[54] ACCESSORY FOR A PROFESSIONAL QUILTING MACHINE

[76] Inventor: Hartley B. Badger, 98686 Fox Dr., Brookings, Oreg. 97415

[21] Appl. No.: 759,061

[22] Filed: Dec. 2, 1996

[51] Int. Cl.[6] ..... D05B 11/00

[52] U.S. Cl. ..... 112/117; 112/470.13; 33/23.01

[58] Field of Search ..... 112/117, 118, 112/119, 102, 103, 2.1, 4, 470.12, 470.13; 33/23.01, 23.11, 1 M

[56] References Cited

U.S. PATENT DOCUMENTS

| | | | |
|---|---|---|---|
| 2,236,421 | 3/1941 | Boettcher | 112/118 |
| 3,377,968 | 4/1968 | Story | 112/470.12 |
| 3,956,828 | 5/1976 | Kloweit | 33/23.11 |
| 4,176,455 | 12/1979 | Copeland et al. | 33/23.01 X |
| 4,192,241 | 3/1980 | Reed et al. | 112/470.13 X |
| 4,969,410 | 11/1990 | Brower et al. | 112/177 X |

*Primary Examiner*—Ismael Izaguirre
*Attorney, Agent, or Firm*—Michael I. Kroll

[57] ABSTRACT

An accessory (10) for a professional quilting machine (12) includes a fence unit (85) which is mounted in an adjustable manner onto a platform (30). The platform (30) has a plurality of grooved rim wheels (34) that ride on lower rails (14) of the quilting machine (12). A brake assembly (38) is on one side (40) of the platform (30), to retain the platform (30) in a stationary position on the lower rails (14). The fence unit (85) will allow an operator to guide the quilting machine (12) to make diagonal quilting sewing lines through layers of fabric with little effort. The fence unit (85) can be substituted with a circle transfer unit (101), so that the operator using the quilting machine (12) can now make circular quilting sewing lines of varying sizes through the layers of the fabric with little effort.

19 Claims, 4 Drawing Sheets

ACCESSORY FOR A PROFESSIONAL QUILTING MACHINE

BACKGROUND OF THE INVENTION

1. Field of the Invention

The instant invention relates generally to quilting machines and more specifically it relates to an accessory for a professional quilting machine.

2. Description of the Prior Art

Numerous quilting machines have been provided in prior art that are adapted to be controlled by operators to sew quilting lines in lateral directions as well as from front to back, while it is presently most difficult to accurately sew diagonal and circular quilting lines. While these units may be suitable for the particular purpose to which they address, they would not be as suitable for the purposes of the present invention as heretofore described.

SUMMARY OF THE INVENTION

A primary object of the present invention is to provide an accessory for a professional quilting machine that will overcome the shortcomings of the prior art devices.

Another object is to provide an accessory for a professional quilting machine that includes a fence unit which will allow the operator to guide the quilting machine to make diagonal quilting sewing lines through layers of fabric with little effort.

An additional object is to provide an accessory for a professional quilting machine in which the fence unit can be substituted with a circle transfer unit, so that the operator can now make circular quilting sewing lines of varying sizes through layers of fabric with little effort.

A further object is to provide an accessory for a professional quilting machine that is simple and easy to use.

A still further object is to provide an accessory for a professional quilting machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 8A:
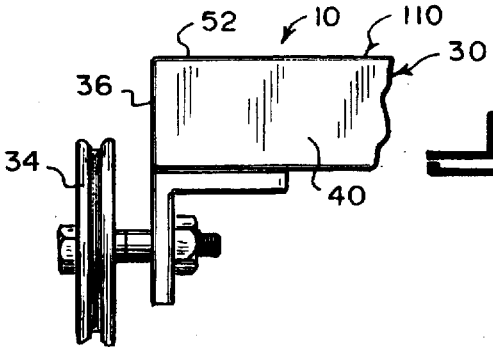
FIG. 8 is a top view of the instant invention as the fence unit, showing a modification in which the grooved rim wheels are vertical.
Figure 8:
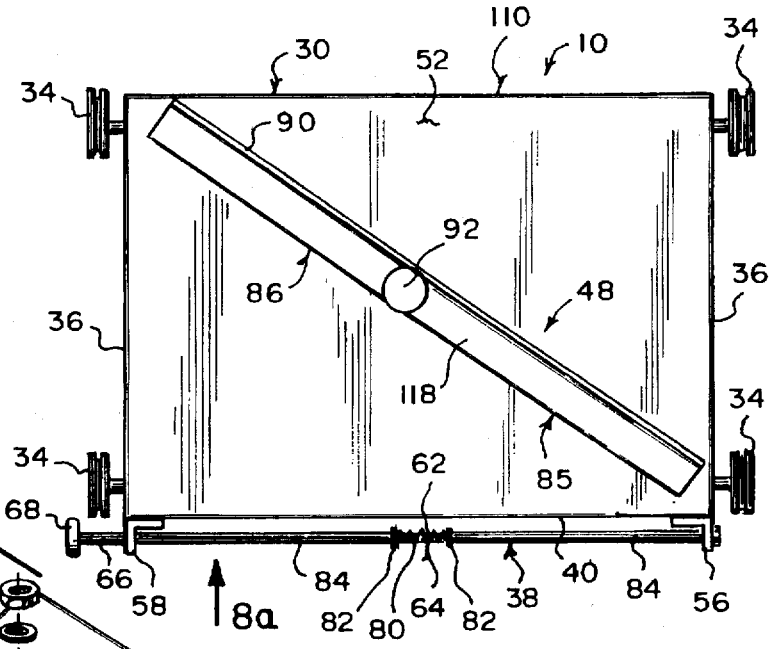

FIG. 8*a* is an end view taken in the direction of arrow 8*a* in FIG. 8, with parts broken away.

Figure 9:
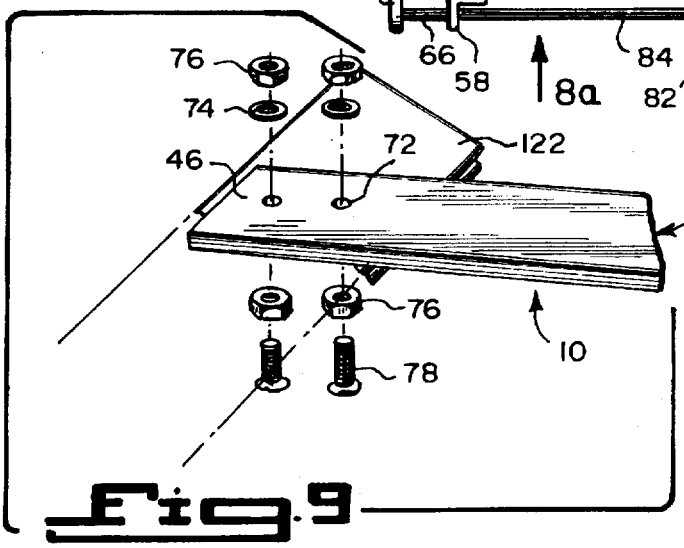

FIG. 9 is a perspective view, with parts exploded and broken away, showing how the idler arm of the instant invention is installed to an orbiter.

Figure 9A:
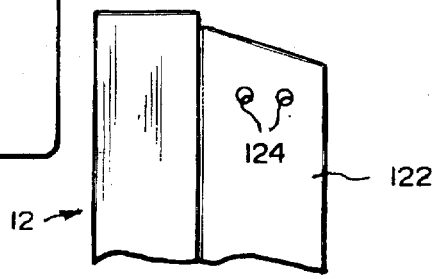

FIG. 9*a* is a diagrammatic top view with parts broken away, showing the orbiter on the quilting machine with two holes therethrough.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate an accessory 10 for a professional quilting machine 12 of the type having a pair of parallel spaced apart lower rails 14 on a support surface 16. A pair of parallel spaced apart upper rails 18 with a plurality of rollers 20 transversely ride upon the lower rails 14. A machine head 22 with operating handles 24, has a plurality of support brackets 26 with rollers 28 that ride upon the upper rails 18. The accessory 10 consists of a platform 30 having a threaded central aperture 32, whereby the platform 30 extends between the lower rails 14. A plurality of grooved rimmed wheels 34 extend from opposite ends 36 of the platform 30, to ride on the lower rails 14. A brake assembly 38 is on one side 40 of the platform 30, to retain the platform 30 in a stationary position on the lower rails 14.

Figure 4:
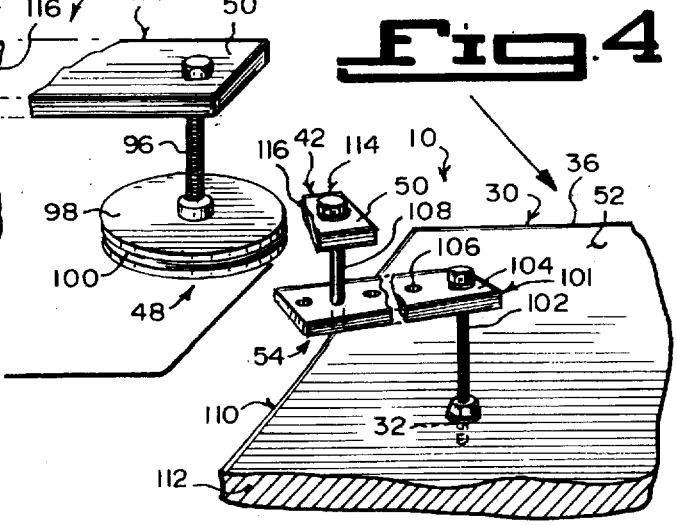
FIG. 4 is a perspective view of a portion of the platform, showing a circle transfer unit connected to the idler arm, to make circular quilting sewing lines through layers of fabric.

An idler arm 42 is provided. An assembly 44 is for attaching a first end 46 of the idler arm 42 to the right front support bracket 26 under the machine head 22 and over the platform 30. A facility 48 is connected between a second end 50 of the idler arm 42 and a top surface 52 of the platform 30, for guiding the machine head 22 to make diagonal quilting sewing lines through layers of fabric with little effort. The accessory 10, as shown in FIG. 4, further includes a structure 54 connected between the second end 50 of the idler arm 42 and the top surface 52 of the platform 30, for operating the machine head 22 to make circular quilting sewing lines through layers of fabric with little effort.

Figure 5:
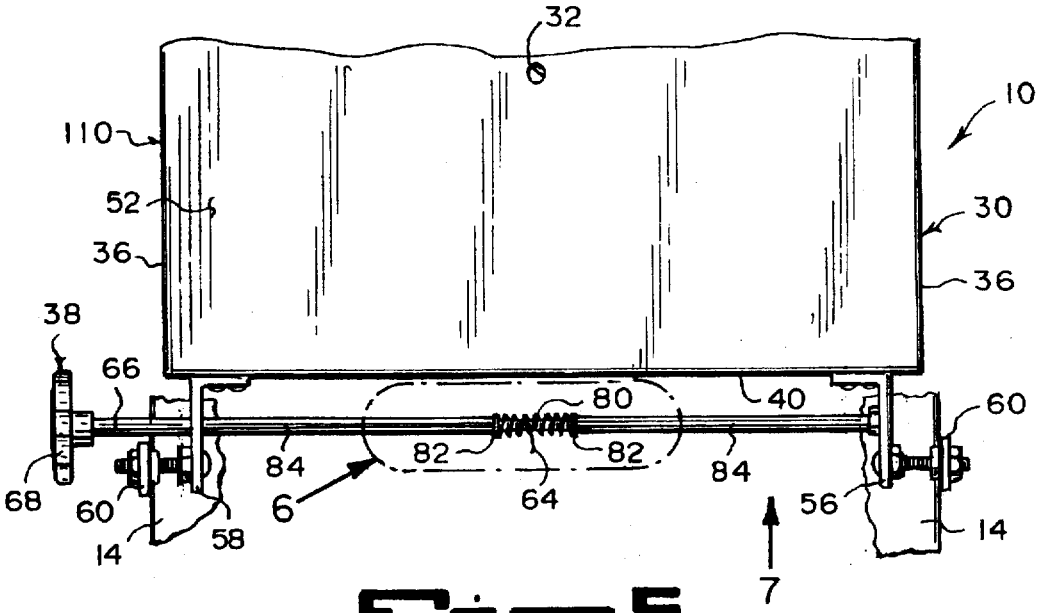
FIG. 5 is a top view taken in the direction of arrow 5 in FIG. 2 with parts broken away, showing the brake assembly in greater detail.
Figure 6:
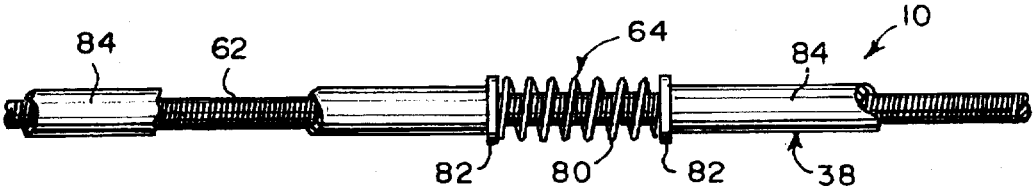
FIG. 6 is an enlarged top view of a portion of the brake assembly as indicated by arrow 6 in FIG. 5 with parts broken away.
Figure 7:
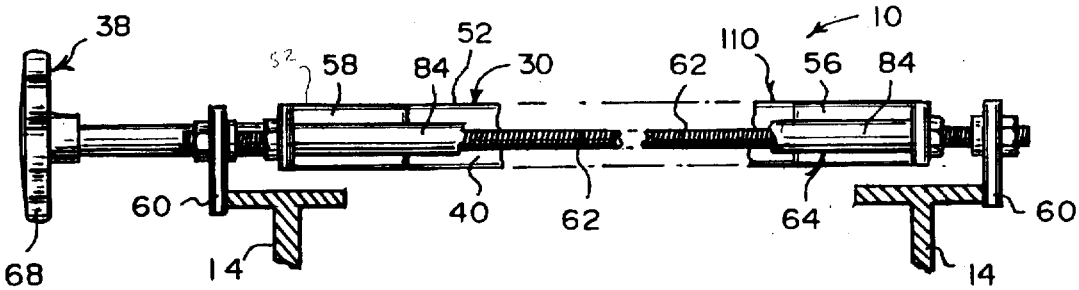
FIG. 7 is an end view taken in the direction of arrow 7 in FIG. 5 with parts broken away.

The brake assembly 38, as best shown in FIGS. 5 to 7, comprises a pair of L-shaped brackets 56, 58. Each L-shaped bracket 56, 58 is mounted to the side 40 of the platform 30 near a corner thereof. A pair of brake feet 60 are provided. Each brake foot 60 is attached to one L-shaped bracket 56, 58, to extend down to one of the lower rails 14. An elongated threaded rod 62 has a first end affixed to the first L-shaped bracket 56, while a second end extends through the second L-shaped bracket 5. A device 64 on the elongated threaded rod 62, is for forcing the brake feet 60 to move away from the lower rails 14. A sleeve 66 is on the second end of the elongated threaded rod 62 that extends through the second L-shaped bracket 58. A brake control knob 68 is threaded onto the second end of the elongated threaded rod 62 against the sleeve 66. When the brake control knob 68 is tightened on the second end of the elongated threaded rod 62, the sleeve 66 will cause the brake feet 60 to bear against the lower rails 14. When the brake control knob 68 is loosened on the second end of the elongated threaded rod 62, the brake feet 60 will move slightly away from the lower rails 14 by help of the forcing device 64, to allow the grooved rimmed wheels 34 on the platform 30 to ride on the lower rails 14.

Figure 3:
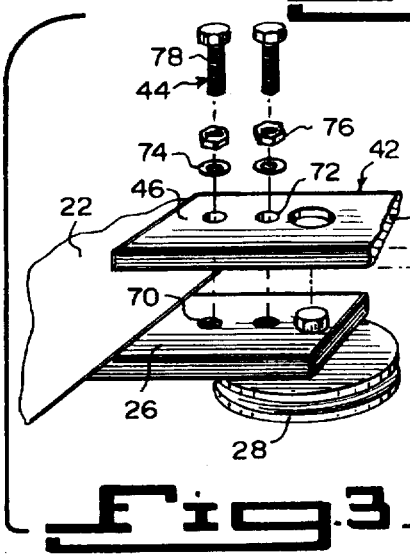
FIG. 3 is a further enlarged perspective view with parts exploded and broken away, showing how the idler arm of the instant invention is installed to a right front support bracket of the machine head.

The attaching assembly 44, as shown in FIG. 3, includes the right front support bracket 26 having a pair of threaded holes 70 therethrough. The idler arm 42 has a pair of apertures 72 therethrough, which are in alignment with the threaded holes 70 in the right front support bracket 26. A pair of flat washers 74, a pair of hex nuts 76 and a pair of screws 78 are provided. Each screw 78 can extend through one hex nut 76, one washer 74, one aperture 72 and into one threaded hole 70.

The forcing device 64 consists of a coil spring 80 centrally located on the elongated threaded rod 62 between the L-shaped brackets 56 and 58. A pair of flat washers 82 are on the elongated threaded rod 62. Each flat washer 82 is up against an opposite end of the coil spring 80. Two pieces of tubing 84 slide upon the elongated threaded rod 62. Each piece of tubing 84 is between one of the L-shaped brackets 56, 58 and one flat washer 82. When the brake control knob 68 is loosened, the coil spring 80 and the flat washers 82 will push the two pieces of tubing 84 against the L-shaped brackets 56, 58, to cause the brake feet 60 to move slightly away from the lower rails 14.

Figure 2:
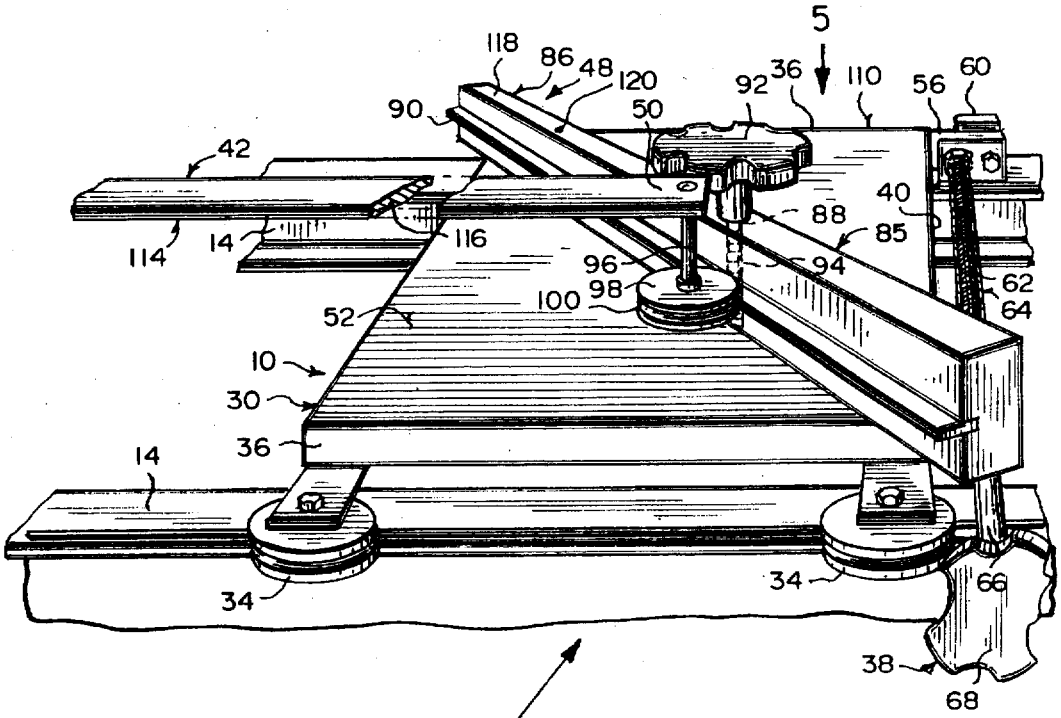
FIG. 2 is an enlarged perspective view taken in the direction of arrow 2 in FIG. 1.

The guiding facility 48, as best seen in FIG. 2, is a fence unit 85 that includes an adjustable arm 86 having a transverse central hole 88 therethrough. A follower blade 90 extends from one side of the adjustable arm 86. An adjustable arm knob 92 having a threaded shank 94, extends through the transverse central hole 88 in the adjustable arm 86 and into the threaded central aperture 32 in the platform 30. The adjustable arm 86 can be set at any angle and the adjustable arm knob 92 then tightened to hold the adjustable arm 86 in a stationary position on the platform 30. A shaft 96 is affixed to and extends downwardly from the second end 50 of the idler arm 42. A cam wheel 98 has an annular groove 100 about its circumference. The cam wheel 98 is rotatively attached to a distal free end of the shaft 96. The annular groove 100 of the cam wheel 98 can ride against the follower blade 90, allowing the idler arm 42 to guide the machine head 22 and make the diagonal quilting sewing lines through layers of fabric with little effort.

The operating structure 54 in FIG. 4, is a circle transfer unit 101 that consists of a threaded post 102 which threads into the threaded central aperture 32 in the platform 30 and extends upwardly therefrom. A rotatable arm 104 is provided, having a plurality of longitudinal spaced apart holes 106 therethrough. The rotatable arm 104 is connected at one end to the threaded post 102, to turn about the threaded post. A pin 108 is affixed to and extends downwardly from the second end 50 of the idler arm 42. The pin 108 can engage with any of the holes 106 in the rotatable arm 104, allowing the idler arm 42 to operate the machine head 22 and make the circular quilting sewing lines of varying sizes through layers of fabric with little effort.

The platform 30 is a rectangular shaped flat board 110 and fabricated out of a strong durable material 112, such as plastic, wood or metal. The idler arm 42 is a flat elongated rectangular shaped rod 114 and fabricated out of a strong durable material 116, such as metal. The adjustable arm 86 is an elongated rectangular shaped bar 118 and is fabricated out of a strong durable material 120.

Figure 1:
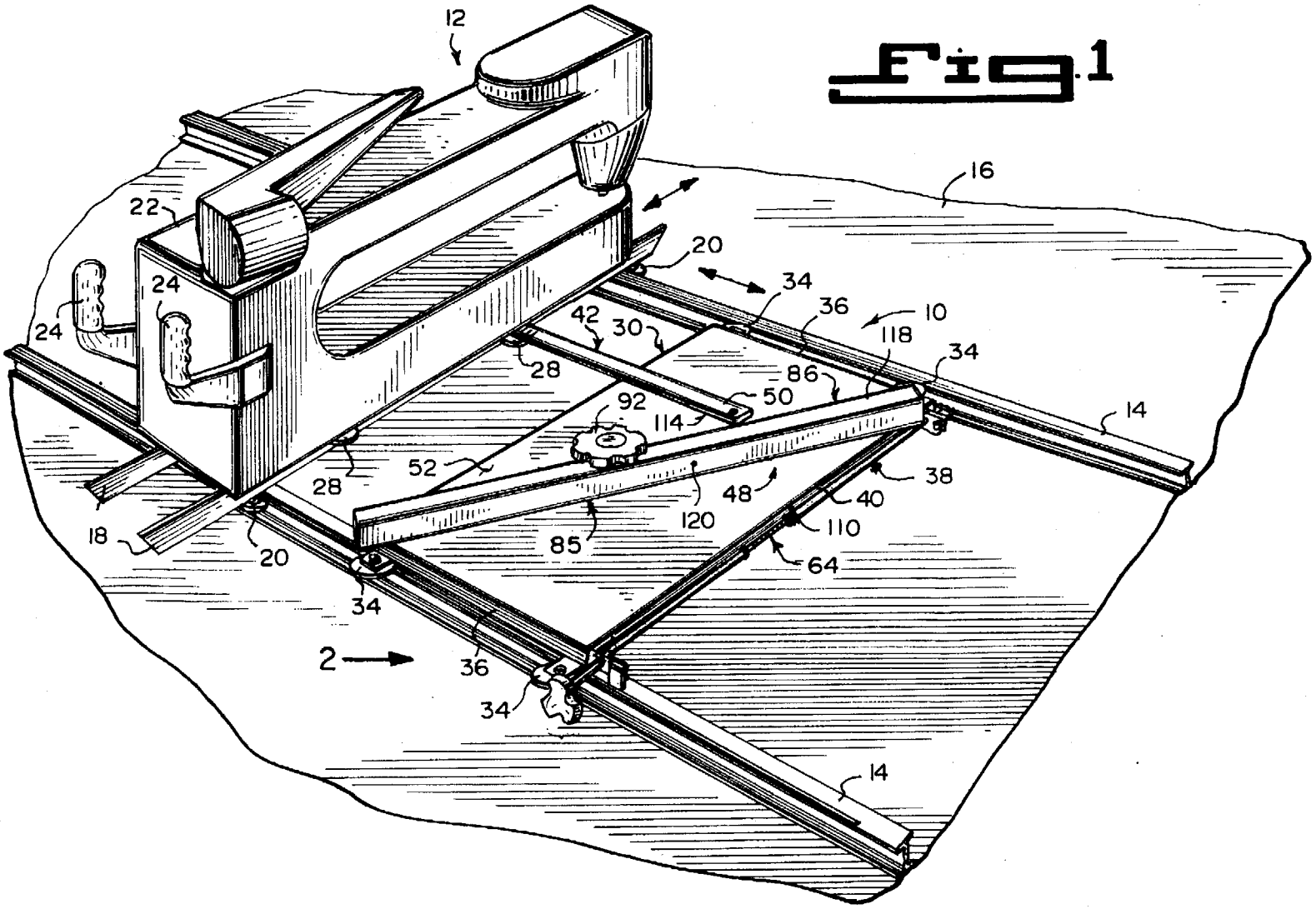
FIG. 1 is a perspective view of the instant invention as a fence unit installed in a quilting machine, to guide the machine head in making diagonal quilting sewing lines through layers of fabric.

The accessory 10 can be used on various quilting machines 12, such as with an APQS Ultimate I and an APQS XX. With very minor modifications the accessory 10 will work with other types of quilting machines 12. The grooved rimmed wheels 34 will be positioned vertically, as shown in FIGS. 8 and 8*a*, rather than horizontally, as shown in FIGS. 1 and 2. The first end 46 of the idler arm 42 can also be attached to an orbiter 122 for quilting machines 12 equipped with an orbiter, as shown in FIGS. 9 and 9*a*. Mounting hardware, such as washers 74, hex nuts 76 and screws 78, shown in FIG. 9, will be used for attaching the first end 46 of the idler arm 42 to the orbiter 122 through holes 124.

LIST OF REFERENCE NUMBERS

10 accessory
12 professional quilting machine
14 lower rail of 12
16 support surface
18 upper rail of 12
20 roller on 18
22 machine head of 12
24 operating handle of 22
26 support bracket on 22
28 roller on 26
30 platform of 10
32 threaded central aperture in 30
34 grooved rim wheel of 10
36 end of 30
38 brake assembly of 10
40 side of 30
42 idler arm of 10
44 attaching assembly of 10
46 first end of 42
48 guiding facility of 10
50 second end of 42
52 top surface of 30
54 operating structure of 10
56 first L-shaped bracket of 38
58 second L-shaped bracket of 38
60 brake foot of 38
62 elongated threaded rod of 38
64 forcing device of 38
66 sleeve of 38
68 brake control knob of 38
70 threaded hole in 26
72 aperture in 42
74 flat washer of 44
76 hex nut of 44
78 screw of 44
80 coil spring of 64
82 flat washer of 64
84 piece of tubing of 64
85 fence unit for 48
86 adjustable arm of 85
88 transverse central hole in 86
90 follower blade on 86
92 adjustable arm knob of 85
94 threaded shank of 92
96 shaft of 85
98 cam wheel of 85
100 annular groove in 98
101 circle transfer unit for 54

102 threaded post of 101
104 rotatable arm of 101
106 hole in 104
108 pin of 101
110 rectangular shaped flat board for 30
112 strong durable material for 110
114 flat elongated rectangular shaped rod for 42
116 strong durable material for 114
118 elongated rectangular shaped bar for 86
120 strong durable material for 118
122 orbiter
124 hole in 122

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An accessory for a professional quilting machine having a pair of parallel spaced apart lower rails on a support surface, a pair of parallel spaced apart upper rails with a plurality of rollers to transversely ride upon the lower rails, a machine head with operating handles having a plurality of support brackets with rollers that ride upon the upper rails, said accessory comprising:

a) a platform having a threaded central aperture, whereby said platform extends between the lower rails;

b) a plurality of grooved rimmed wheels extending from opposite ends of said platform to ride on the lower rails;

c) a brake assembly on one side of said platform, to retain said platform in a stationary position on the lower rails;

d) an idler arm;

e) means for attaching a first end of said idler arm to a right front support bracket under the machine head, so that said idler arm will extend at a right angle from the machine head and over said platform; and f) means connected between a second end of said idler arm and a top surface of said platform, for guiding the machine head to make diagonal quilting sewing lines through layers of fabric.

2. An accessory for a professional quilting machine as recited in claim 1, further including means connected between the second end of said idler arm and the top surface of said platform, for operating the machine head to make circular quilting sewing lines through layers of fabric.

3. An accessory for a professional quilting machine as recited in claim 2, wherein said operating means is a circle transfer unit that includes:

a) a threaded post which threads into the threaded central aperture in said platform and extends upwardly therefrom;

b) a rotatable arm having a plurality of longitudinal spaced apart holes therethrough, whereby said rotatable arm is connected at one end to said threaded post to turn about said threaded post; and c) a pin affixed to and extending downwardly from the second end of said idler arm, wherein said pin is mateable with any of the holes in said rotatable arm, allowing said idler arm to operate the machine head and make the circular quilting sewing lines of varying sizes through layers of fabric.

4. An accessory for a professional quilting machine as recited in claim 1, wherein said brake assembly includes:

a) a pair of L-shaped brackets, whereby each said L-shaped bracket is mounted to a side of said platform near a corner thereof;

b) a pair of brake feet, whereby each said brake foot is attached to one said L-shaped bracket to extend down to one of the lower rails;

c) an elongated threaded rod having a first end affixed to said first L-shaped bracket, while a second end extends through said second L-shaped bracket;

d) means on said elongated threaded rod for forcing said brake feet to move away from the lower rails;

e) a sleeve on the second end of said elongated threaded rod that extends through said second L-shaped bracket; and f) a brake control knob threaded onto the second end of said elongated threaded rod against said sleeve, so that when said brake control knob is tightened on the second end of said elongated threaded rod, said sleeve will cause said brake feet to bear against the lower rails and when said brake control knob is loosened on the second end of said elongated threaded rod, said brake feet will moved slightly away from the lower rails by said forcing means, to allow said grooved rimmed wheels on said platform to ride on the lower rails.

5. An accessory for a professional quilting machine as recited in claim 4, wherein said forcing means includes:

a) a coil spring centrally located on said elongated threaded rod between said L-shaped brackets;

b) a pair of flat washers on said elongated threaded rod, whereby each said flat washer is up against an opposite end of said coil spring; and c) two pieces of tubing which slide upon said elongated threaded rod, whereby each said piece of tubing is between one of said L-shaped brackets and one said flat washer, so that when said brake control knob is loosened said coil spring and said flat washers will push said two pieces of tubing against said L-shaped brackets, to cause said brake feet to move slightly away from the lower rails.

6. An accessory for a professional quilting machine as recited in claim 1, wherein said attaching means includes:

a) the right front support bracket having a pair of threaded holes therethrough;

b) said idler arm having a pair of apertures therethrough, which are in alignment with said threaded holes in the right front support bracket;

c) a pair of flat washers;

d) a pair of hex nuts; and e) a pair of screws, whereby each said screw extends through one said hex nut, one said washer, one said aperture and into one said threaded hole.

7. An accessory for a professional quilting machine as recited in claim 1, wherein said guiding means is a fence unit that includes:

a) an adjustable arm having a transverse central hole therethrough;

b) a follower blade extending from one side of said adjustable arm;

c) an adjustable arm knob having a threaded shank which extends through the transverse central hole in said adjustable arm and into the threaded central aperture in said platform, whereby said adjustable arm is adjustable to any angle when said adjustable arm knob is loosened and is secured in a stationary position on said platform when said adjustable arm knob is tightened;

d) a shaft affixed to and extending downwardly from the second end of said idler arm; and e) a cam wheel having an annular groove about its circumference, said cam wheel rotatively attached to a distal free end of said shaft, so that the annular groove of said cam wheel rides against said follower blade, allowing said idler arm to guide the machine head and make the diagonal quilting sewing lines through layers of fabric.

8. An accessory for a professional quilting machine as recited in claim 7, wherein said adjustable arm is an elongated rectangular shaped bar and fabricated out of a strong durable material.

9. An accessory for a professional quilting machine as recited in claim 1, wherein said platform is a rectangular shaped flat board and fabricated out of a strong durable material.

10. An accessory for a professional quilting machine as recited in claim 1, wherein said idler arm is a flat elongated rectangular shaped rod and fabricated out of a strong durable material.

11. An accessory for a professional quilting machine having a pair of parallel spaced apart lower rails on a support surface, a pair of parallel spaced apart upper rails with a plurality of rollers to transversely ride upon the lower rails, a machine head with operating handles having a plurality of support brackets with rollers that ride upon the upper rails, said accessory comprising:

a) a platform having a threaded central aperture, whereby said platform extends between the lower rails;

b) a plurality of grooved rimmed wheels extending from opposite ends of said platform to ride on the lower rails;

c) a brake assembly on one side of said platform, to retain said platform in a stationary position on the lower rails;

d) an idler arm;

e) means for attaching a first end of said idler arm to a right front support bracket under the machine head, so that said idler arm will extend at a right angle from the machine head and over said platform;

f) means connected between a second end of said idler arm and a top surface of said platform, for guiding the machine head to make diagonal quilting sewing lines through layers of fabric; and g) means connected between the second end of said idler arm and the top surface of said platform, for operating the machine head to make circular quilting sewing lines through layers of fabric.

12. An accessory for a professional quilting machine as recited in claim 11, wherein said brake assembly includes:

a) a pair of L-shaped brackets, whereby each said L-shaped bracket is mounted to a side of said platform near a corner thereof;

b) a pair of brake feet, whereby each said brake foot is attached to one said L-shaped bracket to extend down to one of the lower rails;

c) an elongated threaded rod having a first end affixed to said first L-shaped bracket, while a second end extends through said second L-shaped bracket;

d) means on said elongated threaded rod for forcing said brake feet to move away from the lower rails;

e) a sleeve on the second end of said elongated threaded rod that extends through said second L-shaped bracket; and f) a brake control knob threaded onto the second end of said elongated threaded rod against said sleeve, so that when said brake control knob is tightened on the second end of said elongated threaded rod, said sleeve will cause said brake feet to bear against the lower rails and when said brake control knob is loosened on the second end of said elongated threaded rod, said brake feet will be moved slightly away from the lower rails by said forcing means, to allow said grooved rimmed wheels on said platform to ride on the lower rails.

13. An accessory for a professional quilting machine as recited in claim 12, wherein said attaching means includes:

a) the right front support bracket having a pair of threaded holes therethrough;

b) said idler arm having a pair of apertures therethrough, which are in alignment with said threaded holes in the right front support bracket;

c) a pair of flat washers;

d) a pair of hex nuts; and e) a pair of screws, whereby each said screw extends through one said hex nut, one said washer, one said aperture and into one said threaded hole.

14. An accessory for a professional quilting machine as recited in claim 13, wherein said forcing means includes:

a) a coil spring centrally located on said elongated threaded rod between said L-shaped brackets;

b) a pair of flat washers on said elongated threaded rod, whereby each said flat washer is up against an opposite end of said coil spring; and c) two pieces of tubing which slide upon said elongated threaded rod, whereby each said piece of tubing is between one of said L-shaped brackets and one said flat washer, so that when said brake control knob is loosened said coil spring and said flat washers will push said two pieces of tubing against said L-shaped brackets, to cause said brake feet to move slightly away from the lower rails.

15. An accessory for a professional quilting machine as recited in claim 14, wherein said guiding means is a fence unit that includes:

a) an adjustable arm having a transverse central hole therethrough;

b) a follower blade extending from one side of said adjustable arm;

c) an adjustable arm knob having a threaded shank which extends through the transverse central hole in said adjustable arm and into the threaded central aperture in said platform, whereby said adjustable arm is adjustable to any angle when said adjustable arm knob is loosened and is secured in a stationary position on said platform when said adjustable arm knob is tightened;

d) a shaft affixed to and extending downwardly from the second end of said idler arm; and e) a cam wheel having an annular groove about its circumference, said cam wheel rotatively attached to a distal free end of said shaft, so that the annular groove of said cam wheel ride against said follower blade, allowing said idler arm to guide the machine head and make the diagonal quilting sewing lines through layers of fabric.

16. An accessory for a professional quilting machine as recited in claim 15, wherein said operating means is a circle transfer unit that includes:

a) a threaded post which threads into the threaded central aperture in said platform and extends upwardly therefrom;

b) a rotatable arm having a plurality of longitudinal spaced apart holes therethrough, whereby said rotatable arm is connected at one end to said threaded post to turn about said threaded post; and c) a pin affixed to and extending downwardly from the second end of said idler arm, wherein said pin is mateable with any of the holes in said rotatable arm, allowing said idler arm to operate the machine head and make the circular quilting sewing lines of varying sizes through layers of fabric.

17. An accessory for a professional quilting machine as recited in claim 16, wherein said platform is a rectangular shaped flat board and fabricated out of a strong durable material.

18. An accessory for a professional quilting machine as recited in claim 17, wherein said idler arm is a flat elongated rectangular shaped rod and fabricated out of a strong durable material.

19. An accessory for a professional quilting machine as recited in claim 18, wherein said adjustable arm is an elongated rectangular shaped bar and fabricated out of a strong durable material.

* * * * *